United States Patent [19]

Reid

[11] Patent Number: 4,822,378

[45] Date of Patent: Apr. 18, 1989

[54] PROCESS AND COMPOSITION FOR COLOR STABILIZED DISTILLATE FUEL OILS

[75] Inventor: Dwight K. Reid, Houston, Tex.

[73] Assignee: Betz Laboratories, Inc., Trevose, Pa.

[21] Appl. No.: 18,887

[22] Filed: Feb. 25, 1987

[51] Int. Cl.[4] ..... C10L 1/22; C10L 1/18

[52] U.S. Cl. ..... 44/53; 44/59; 44/72

[58] Field of Search ..... 44/53, 72

[56] References Cited

U.S. PATENT DOCUMENTS

| | | | |
|---|---|---|---|
| 2,672,408 | 3/1954 | Bonner | 44/72 |
| 2,945,749 | 7/1960 | Andress, Jr. | 44/72 |
| 3,049,414 | 8/1962 | Kruyff | 44/63 |
| 3,186,810 | 6/1965 | Dunworth | 44/62 |
| 3,336,124 | 8/1967 | Dunworth | 44/62 |
| 3,355,490 | 11/1967 | Van Munster | 44/72 |
| 3,490,882 | 1/1970 | Dunworth | 44/73 |
| 3,640,692 | 2/1972 | Rakow et al. | 44/63 |
| 3,681,463 | 8/1972 | Lee | 44/72 |
| 3,701,641 | 10/1972 | Rakow et al. | 44/73 |
| 3,818,006 | 6/1974 | Klemchuk | 260/249.5 |
| 4,208,190 | 6/1980 | Malec | 44/72 |
| 4,440,625 | 4/1984 | Go et al. | 208/48 AA |
| 4,456,526 | 6/1984 | Miller et al. | 208/48 AA |
| 4,509,952 | 4/1985 | Braxton, Jr. | 44/57 |
| 4,647,289 | 3/1987 | Reid | 44/72 |
| 4,647,290 | 3/1987 | Reid | 44/72 |

FOREIGN PATENT DOCUMENTS 2157670 10/1985 United Kingdom .

*Primary Examiner*—William R. Dixon, Jr.
*Assistant Examiner*—E. McAvoy
*Attorney, Agent, or Firm*—Alexander D. Ricci; Steven D. Boyd

[57] ABSTRACT

This invention relates to processes and compositions for color stabilized distillate fuel oils which comprises an effective color stabilizing amount of (a) a tertiary amine having the formula

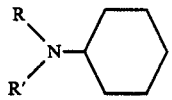

wherein R and R′ are the same or different alkyl groups having one to about six carbon atoms, and (b) a hydroxylamine having the formula

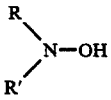

wherein R and R′ are the same or different and are hydrogen, alkyl, alkaryl or aralkyl groups, wherein the weight ratio of (a):(b) is from about 1:1 to about 99.7:0.3. Preferably, the alkyl, alkaryl and aralkyl groups of the hydroxylamine have from one to about twenty carbon atoms. It is further preferred that (a) is N,N-dimethylcyclohexylamine and (b) is N,N-diethylhydroxylamine.

15 Claims, No Drawings

PROCESS AND COMPOSITION FOR COLOR STABILIZED DISTILLATE FUEL OILS

BACKGROUND OF THE INVENTION

1. Field of the Invention

This invention relates to color stabilized distillate fuel oils. More particularly, this invention relates to inhibiting color deterioration of distallate fuel oils, such as diesel fuel.

2. Description of the Prior Art

Various middle distillate fuel oils such as diesel fuel and kerosene tend, with time, to deteriorate. Discoloration of distillate fuel oils is objectionable for various reasons, including customers' preference for light colored fuel oils because discoloration may indicate that deterioration has occurred.

Suggestions of the prior art for stabilizing fuel oils include U.S. Pat. No. 2,672,408, Bonner, which discloses the use of oil-soluble water-insoluble amines, the general formula of which can be represented as: $N(R)_3$, wherein R can be hydrogen or the same or different hydrocarbon radicals with at least one R being a nonaromatic hydrocarbon radical, for protection of particular blends of liquid hydrocarbons against discoloration. U.S. Pat. No. 2,945,749, Andress, discloses the use of a tertiary alkyl, primary, monoamine having from about 4 to 24 carbon atoms and in which the primary nitrogen atom is directly attached to a tertiary carbon atom, for inhibiting fuel oil deterioration in storage. U.S. Pat. No. 3,049,414, Kruyff, discloses a process for stabilizing the color of gasoline comprising the steps of washing the gasoline with a liquid characterized as being free of heavy metals and capable of dissolving pyridine; washing with alkaline aqueous solution, characterized as being free of heavy metals; removing substantially all the free alkali; and then adding an organic nitrogenous base, all of whose carbon-carbon bonds are saturated. U.S. Pat. No. 3,186,810, Dunworth, discloses a distillate hydrocarbon fuel oil containing a certain oil-soluble, basic amino nitrogen-containing addition type copolymer and an N-substituted cyclohexylamine in which the substituents consist of 1 to 2 alkyl groups of 1 to 4 carbon atoms. Also, U.S. Pat. No. 3,336,124, Dunworth, discloses a distillate hydrocarbon fuel oil containing certain oil-soluble polymeric dispersants and an N-substituted cyclohexylamine in which the substituents consist of 1 to 2 alkyl groups of 1 to 4 carbon atoms.

Of primary interest is U.S. Pat. No. 3,490,882, Dunworth, which relates to stabilized petroleum distillate fuel oils containing N,N-dimethylcyclohexylamine, and optionally, an N,N'-di(orthohydroxyarylidene)-1,2-alkylenediamine. U.S. Pat. No. 3,640,692, Rakow, et. al., discloses a stabilized distillate hydrocarbon fuel oil composition comprising a major proportion of a distillate hydrocarbon fuel and a minor proportion of a stabilizer comprising (a) an additive selected from the group consisting of (1) an amide plus a Schiff base; (2) an amide containing a Schiff base group; and (3) an amide containing a Schiff base group in combination with either an amide or a Schiff base; and (b) a cyclohexylamine selected from the group consisting of N,N-dimethylcyclohexylamine and dicyclohexylamine. Also, U.S. Pat. No. 3,701,641, discloses a stabilized distillate hydrocarbon fuel oil composition comprising a major proportion of a distillate hydrocarbon fuel and a minor proportion of a stabilizing additive comprised of (a) a polyamine having 2 to about 6 amino groups and containing about 24 to 50 carbons; (b) N,N'-disalicylidine-1,2-propylenediamine, and (c) a cyclohexylamine selected from the group consisting of N,N-dimethylcyclohexylamine and dicyclohexylamine. Additionally, U.S. Pat. No. 3,818,006, Klemchuk, discloses the use of sundry substituted hydroxylamines for stabilizing diverse organic materials against oxidation.

Of particular interest is U.S. Pat. No. 4,440,625, Go et al., which teaches that hydrocarbon process equipment is protected against fouling by incorporating into the hydrocarbon being processed small amounts of a composition comprised of a dialkylhydroxylamine and an organic sufactant. Moreover, U.K. Pat. No. 2,157,670, Nemes et al., discloses a composition containing a hydroxylamine compound; a quinone, a dihydroxylbenzene, or an aminohydroxybenzene compound; and a neutralizing amine which is useful as an oxygen scavenger and corrosion inhibitor in boiler water and other aqueous systems. Additionally, U.S. Pat. No. 4,456,526, Miller et al., teaches that hydrocarbon process equipment is protected against fouling by incorporating into the hydrocarbon being processed small amounts of a composition comprised of a dialkylhydroxylamine and a tertiary alkyl-catechol. U.S. Pat. No. 4,509,952, relates to an alkyldimethylamine ranging from $C_4$–$C_{20}$ alkyl which may be added to a distillate fuel as a stabilizer to prevent fuel oil degradation. However, none of these prior art references disclose the unique and effective mixture of a tertiary amine and a hydroxylamine in accordance with the instant invention for inhibiting color deterioration of distillate fuel oils.

SUMMARY OF THE INVENTION

This invention relates to processes for inhibiting color deterioration of distillate fuel oil which comprises adding to the distillate fuel oil an effective inhibiting amount of a mixture of (a) a tertiary amine having the formula

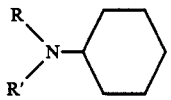

wherein R and R' are the same or different alkyl groups having one to about six carbon atoms, and (b) a hydroxylamine having the formula

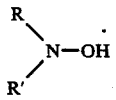

wherein R and R' are the same or different and are hydrogen, alkyl, alkaryl or aralkyl groups, wherein the weight ratio of (a):(b) is from about 1:1 to about 99.7:03. Preferably, the alkyl, alkaryl and aralkyl groups of the hydroxylamine have from one to about twenty carbon atoms.

This invention also relates to color stabilized distillate fuel oil compositions comprising distillate fuel oil and an effective color stabilizing amount of (a) and (b) as defined above, wherein the weight ratio of (a):(b) is from about 1:1 to about 99.7:03. Generally, the total amount of the mixture of (a) and (b) is from about 1.0 part to about 10,000 parts per million parts of the fuel oil. It is preferred that the weight ratio of (a):(b) is from about 90:10 to about 99.7:0.3. It is further preferred that (a) is N,N-dimethylcyclohexylamine and (b) is N,N-diethylhydroxylamine. This mixture of (a) and (b) provides an unexpectedly higher degree of color stabilization of distillate fuel oils than the individual ingredients comprising the mixture. It is therefore possible to produce a more effective color stabilized composition and process than is obtainable by the use of each ingredient alone. Because of the enhanced color stabilizing activity of the mixture, the concentrations of each of the ingredients may be lowered and the total amount of (a) and (b) required for an effective color stabilizing treatment may be reduced.

Accordingly, it is an object of the present invention to provide processes and compositions for color stabilizing distillate fuel oils. It is a further object of this invention to inhibit color deterioration of distillate fuel oils. These and other objects and advantages of the present invention will be apparent to those skilled in the art upon reference to the following description of the preferred embodiments.

DESCRIPTION OF THE PREFERRED EMBODIMENTS

The present invention pertains to a process for inhibiting color deterioration of distillate fuel oil habing hydrocarbon components distilling from about 300° F., which comprises adding to the distillate fuel oil an effective inhibiting amount of a mixture of (a) a tertiary amine having the formula

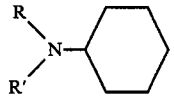

wherein R and R′ are the same or different alkyl groups having one to about six carbon atoms, and (b) a hydroxylamine having the formula

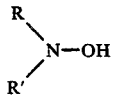

wherein R and R′ are the same or different and are hydrogen, alkyl, alkaryl or aralkyl groups, wherein the weight ratio of (a):(b) is from about 1:1 to about 99.7:0.3. Preferably, the alkyl, alkaryl and aralkyl groups of the hydroxylamine have from one to about twenty carbon atoms. The amounts or concentrations of these two components of this invention can vary depending on, among other things, the tendency of the distillate fuel oil to undergo color deterioration. While from the disclosure of this invention it would be within the capability of those skilled in the art to find by simple experimentation the optimum amounts or concentrations of (a) and (b) for any particular distillate fuel oil, generally the total amount of the mixture of (a) and (b) which is added to the distillate fuel oil is from about 1.0 part to about 10,000 parts per million parts of the distillate fuel oil. Preferably, the mixture of (a) and (b) is added in an amount from about 1.0 part to about 1,500 parts per million. It is also preferred that the weight ratio of (a):(b) is from about 90:10 to about 99.7:0.3 based on the total combined weight of these two components. Most preferably, the weight ratio of (a):(b) is about 99.5:0.5 based on the total combined weight ratio of these two components. It is further preferred that component (a) is N,N-dimethylcyclohexylamine and component (b) is N,N-diethylhydroxylamine.

The aforementioned two components are individually presently available commercially. The components can be added to the distillate fuel oil by any conventional method. The two components can be added to the distillate fuel oil as a single mixture containing both compounds or the individual components can be added separately or in any other desired combination. The mixture may be added either as a concentrate or as a solution using a suitable carrier solvent which is compatible with the components and distillate fuel oil. The mixture can also be added at ambient temperature and pressure to color stabilize the distillate fuel oil during storage. The mixture is preferably added to the distillate fuel oil prior to any appreciable color deteriortation of the fuel oil as this will either eliminate color deterioration or effectively reduce the increase in color formation. However, the mixture is also effective even after some color deterioration has occurred.

The present invention also pertains to a color stabilized distillate fuel oil composition comprising a major portion of distillate fuel oil and a minor portion of an effective color stabilizing amount of (a) a tertiary amine having the formula

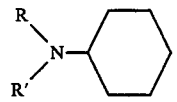

wherein R and R′ are the same or different alkyl groups having one to about six carbon atoms, and (b) a hydroxylamine having the formula

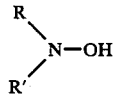

wherein R and R′ are the same or different and are hydrogen, alkyl, alkaryl or aralkyl groups, wherein the weight ratio of (a):(b) is from about 1:1 to about 99.7:0.3. Preferably, the alkyl, alkaryl and aralkyl groups of the hydroxylamine have from one to about twenty carbon atoms. Generally, the total amount of (a) and (b) is from about 1.0 part to about 10,000 parts per million parts of the distillate fuel oil, and preferably, the total amount of (a) and (b) is from about 1.0 part to about 1,500 parts per million parts of the distillate fuel oil. It is also preferred that the weight ratio of (a):(b) is from about 90:10 to about 99.7:0.3 based on the total combined weight of these two components and, most preferably, the weight ratio of (a):(b) is about 99.5:0.5 based on the total combined weight of these two components.

The distillate fuel oils of this invention are those fuel oils having hydrocarbon components distilling from about 300° F. to about 700° F., such as kerosene, jet fuel and diesel fuel. Included are straight-run fuel oils, thermally cracked, catalytically cracked, thermally reformed, and catalytically reformed oil stocks, and blends thereof which are susceptible to color deterioration. Preferably, the distillate fuel oil is a blend or mixture of diesel fuels which consists of three components: (1) light cycle oil (LCO), (2) straight-run diesel (STRD), and (3) kerosene. Generally, STRD and kerosene have fewer stability problems. LCO's, although less stable, are still acceptable as fuels. However, when the three constituents are blended together, the final diesel fuel product can become unstable. Additionally, some thermally cracked fuel blends can be quite unstable if the process crude stream contains high levels of naturally occurring nitrogen and sulfur compounds.

The processes and compositions of the instant invention effectively color stabilize the distillate fuel oils, particularly during storage. The term "color stabilize" as used herein means that color deterioration of the distillate fuel oil is inhibited. In order to more clearly illustrate this invention, the data set forth below was developed. The following examples are included as being illustrations of the invention and should not be construed as limiting the scope thereof.

EXAMPLES

There are several accelerated test methods that are used by refineries for determining the stability of diesel fuels. Some of the most widely accepted test methods are the 110° F. dark storage test (one week to three months), DuPont F21-61, UOP test method 413, 80° C. test, and the 216° F. test. It was observed that some diesel fuels respond positively to selected chemical additives under specific conditions. In some cases, additives that were effective under accelerated test conditions (e.g., 216° F., 300° F.), were occasionally found to perform poorly under the more moderate 110° F. test. This observation agrees with those found in the recent literature. See Stavinoha, L. L., et. al., "*Accelerated Stability Test Techniques for Diesel Fuels,*" October, 1980. Stability data obtained using the 216° F. or 300° F. accelerated tests are considered to be only qualitative indicators of the performance expectations of an additive under the highly regarded 110° F. storage test condition. It is widely accepted among researchers that seven days at 110° F. is equivalent to one month's storage at 72° F. Although the results of the 110° F. dark storage test are generally accepted as the only valid data in correlating data from these conditions to those from actual storage, some current manufacturers continue to rely on stability data from the more accelerated conditions.

The effect of the components to inhibit color deterioration of a diesel fuel containing 18% light cycle oil was tested using the 90 minute, 300° F. accelerated test method. 50 mL of the diesel fuel sample spiked with the appropriate treatment was filtered through a Whatman No. 1 filter paper and into a test tube. The test tube was then supported in an oil bath maintained at 300°±2° F. The bath oil level was kept above the sample level in the test tube. After 90 minutes, the test tube was removed from the oil bath and stored at room temperature for another 90 minutes. The sample was then filtered through a clean Whatman No. 1 filter paper with moderate vacuum. After the filter paper appeared dry, the test tube was washed with mixed hexanes and the washings were transferred to the filter. The washing and transferring steps were repeated once more. Then all traces of the oil were removed from the filter paper by washing it with a stream of mixed hexanes from a wash bottle. The vacuum was maintained until the filter paper was dry. The filter paper was thereafter transferred to a reflectometer where the percent reflectance of the sample was measured. The color of the sample was determined by visual comparison with known standards according to the ASTM-D-1500 procedure, which involved mathing the color of the fuel samples with ASTM-1500 color numbers. The results are based on a scale of 0.5 to 8.0 wherein increasing values indicate increasing darkness of the sample. The results obtained are reported in Table I below.

TABLE I

| Additive | Concentration (ppm) | ASTM Color |
|---|---|---|
| Untreated | — | 2.7 |
| N,N—diethylhydroxylamine | 0.5 | 2.7 |
| N,N—dimethylcyclohexylamine | 99.5 | 2.3 |
| N,N—dimethylcyclohexylamine/ N,N—diethylhydroxylamine | 99.5/0.5 | 2.0 |

The results reported in Table I demonstrate the unique and exceptionally effective relationship of the components of this invention since the sample containing N,N-dimethylcyclohexylamine (DMCA) and N,N-diethylhydroxylamine (DEHA) wherein the weight ratio of DMCA:DEHA was 99.5:0.5 shows superior effectiveness in inhibiting color deterioration of the diesel fuel than was obtainable in using each of the components individually.

Additional tests were conducted with the above-described diesel fuel using the 90 minute, 300° F. accelerated test method, at various additive concentrations. The results are reported in Table II below.

TABLE II

| Treatment | Dosage (ppm) | ASTM Color |
|---|---|---|
| Untreated | — | 3.5 |
| Commercially available stabilizer believed to be exclusively dibutylamine | 10 | 3.3 |
| | 20 | 3.2 |
| | 40 | 3.0 |
| | 75 | 2.8 |
| | 100 | 2.7 |
| Commercially available stabilizer believed to be exclusively dimethylcyclohexylamine | 10 | 3.2 |
| | 20 | 3.0 |
| | 40 | 2.8 |
| | 75 | 2.6 |
| | 100 | 2.4 |
| DMCA and DEHA (99.5:0.5) | 10 | 2.9 |
| | 20 | 2.7 |
| | 40 | 2.5 |
| | 75 | 2.4 |
| | 100 | 2.0 |

DMCA = N,N—dimethylcyclohexylamine
DEHA = N,N—diethylhydroxylamine

Further tests were conducted to determine the effect of the components to inhibit color deterioration of a straight-run diesel fuel derived from 50% San Joaquin Valley crude and 50% North Alaska crude using the 110° F. dark storage test. 100 mLs of the diesel fuel were transferred into glass bottles. Caps were secured on the bottled samples, but not tightly in order to expose the fuel to atmospheric conditions. The samples were placed in an oven set at 110° F. for 14 days. The samples were then removed from the oven and allowed to cool to room temperature. After each sample had cooled, it was poured into a separatory funnel and filtered (dispersed) through a tared Gooch crucible containing two glass-fiber filter papers. The ASTM-D-1500 procedure was used to determine the color of the filtrant. The results obtained are reported in Table III below.

TABLE III

| Treatment | ASTM Color Level |
|---|---|
| Untreated | 3.8 |
| 100 ppm DMCA/100 ppm DEHA | 3.3 |

TABLE III-continued

| Treatment | ASTM Color Level |
|---|---|
| 50 ppm DMCA/50 ppm DEHA | 3.7 |
| 150 ppm DMCA/40 ppm DEHA | 3.3 |
| 75 ppm DMCA/20 ppm DEHA | 3.7 |

DMCA = N,N—dimethylcyclohexylamine
DEHA = N,N—diethylhydroxylamine

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A process for inhibiting color deterioration of distillate fuel oil which comprises adding to said fuel oil an effective inhibiting amount of a mixture of (a) a tertiary amine having the formula

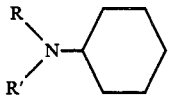

wherein R and R′ are the same or different alkyl groups having one to about six carbon atoms, and (b) a hydroxylamine having the formula

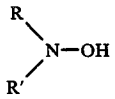

wherein R and R′ are the same or different and are hydrogen, alkyl, alkaryl or aralkyl groups, wherein the weight ratio of (a):(b) is from about 1:1 to about 99.7:0.3.

2. The process of claim 1 wherein said mixture is added in an amount from about 1.0 part to about 10,000 parts per million parts of said fuel oil.

3. The process of claim 1 wherein said mixture is added to said fuel oil prior to color deterioration of the fuel oil.

4. The process of claim 1 wherein said (a) tertiary amine is N,N-dimethylcyclohexylamine and said (b) hydroxylamine is N,N-dimethylhydroxylamine.

5. The process of claim 1 or 4 wherein the weight ratio of (a):(b) is from about 90:10 to about 99.7:0.3.

6. The process of claim 5 wherein the distillate fuel oil is a blended diesel fuel.

7. The process of claim 6 wherein the weight ratio of (a):(b) is about 99.5:0.5.

8. The process of claim 7 wherein said mixture is added in an amount from about 1.0 part to about 1,500 parts per million parts of said diesel fuel.

9. A color stabilized distillate fuel oil composition comprising distillate fuel oil and an effective color stabilizing amount of (a) a tertiary amine having the formula

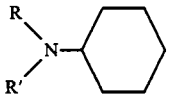

wherein R and R′ are the same or different alkyl groups having one to about six carbon atoms, and (b) a hydroxylamine having the formula

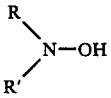

wherein R and R′ are the same or different and are hydrogen, alkyl, alkaryl or aralkyl groups, wherein the weight ratio of (a):(b) is from about 1:1 to about 99.7:0.3.

10. The composition of claim 9 wherein the total amount of (a) and (b) is from about 1.0 part to about 10,000 parts per million parts of said fuel oil.

11. The composition of claim 9 wherein said (a) tertiary amine is N,N-dimethylcyclohexylamine and said (b) hydroxylamine is N,N-diethylhydroxylamine.

12. The composition of claim 9 or 11 wherein the weight ratio of (a):(b) is from about 90:10 to about 99.7:0.3.

13. The composition of claim 12 wherein the distillate fuel oil is a blended diesel fuel.

14. The composition of claim 13 wherein the weight ratio of (a):(b) is about 99.5:5:0.5.

15. The composition of claim 14 wherein the total amount of (a) and (b) is from about 1.0 part to about 1,500 parts per million parts of said diesel fuel.

* * * * *

UNITED STATES PATENT AND TRADEMARK OFFICE

CERTIFICATE OF CORRECTION

PATENT NO. : 4,822,378

DATED : April 18, 1989

INVENTOR(S) : Reid

It is certified that error appears in the above-identified patent and that said Letters Patent is hereby corrected as shown below:

Claim 4, line 3, change "N,N-dimethylhydroxylamine" to

--- N,N-diethylhydroxylamine ---.

Signed and Sealed this

Tenth Day of April, 1990

*Attest:*

HARRY F. MANBECK, JR.

*Attesting Officer*

*Commissioner of Patents and Trademarks*